US011261576B1

(12) United States Patent
Gupta

(10) Patent No.: US 11,261,576 B1
(45) Date of Patent: Mar. 1, 2022

(54) RAPID CONSOLIDATION AND COMPACTION METHOD FOR SOIL IMPROVEMENT OF VARIOUS LAYERS OF SOILS AND INTERMEDIATE GEOMATERIALS IN A SOIL DEPOSIT

(71) Applicant: Ramesh Chandra Gupta, Ashburn, VA (US)

(72) Inventor: Ramesh Chandra Gupta, Ashburn, VA (US)

( * ) Notice: Subject to any disclaimer, the term of this patent is extended or adjusted under 35 U.S.C. 154(b) by 0 days.

(21) Appl. No.: 17/090,858

(22) Filed: Nov. 5, 2020

Related U.S. Application Data

(63) Continuation-in-part of application No. 17/075,244, filed on Oct. 20, 2020.

(51) Int. Cl.
*E02D 5/24* (2006.01)
*E02D 27/16* (2006.01)
*E02D 7/02* (2006.01)

(52) U.S. Cl.
CPC ..... *E02D 5/24* (2013.01); *E02D 7/02* (2013.01); *E02D 27/16* (2013.01); *E02D 2200/1685* (2013.01); *E02D 2250/0007* (2013.01); *E02D 2300/0079* (2013.01)

(58) Field of Classification Search
CPC ..... E02D 3/08; E02D 5/385; E02D 27/18; E02D 2250/0007; E02D 27/32; E02D 3/106; E02D 7/02; E02D 2200/1685; E02D 2250/0023; E02D 27/16; E02D 5/24
See application file for complete search history.

(56) References Cited

U.S. PATENT DOCUMENTS 3,184,924 A * 5/1965 Heinz ..... E02D 5/44 405/237
3,420,063 A * 1/1969 Bodine, Jr. ..... E02D 3/106 405/50
3,772,892 A * 11/1973 Ogawa ..... E02D 3/106 405/171
3,925,998 A * 12/1975 LeCorgne ..... E02D 5/226 405/242
4,126,007 A 11/1978 Mars
4,165,198 A * 8/1979 Farmer ..... E02D 5/385 405/222
4,451,175 A * 5/1984 Yamashita ..... E02D 3/10 383/1
7,604,437 B2 * 10/2009 Wissmann ..... E02D 3/08 405/232
2015/0330051 A1 * 11/2015 White ..... E02D 27/18 405/249

* cited by examiner

*Primary Examiner* — Carib A Oquendo

(57) ABSTRACT

The rapid consolidation and compaction method comprises (i) first driving a hollow pipe, (ii) driving a pipe with a removable end plate after filling and compacting the sandy material in it, through the hollow pipe, to required depth, creating high excess pore-water pressures in the range of 50 to 300 KPa in clayey soils, (iv) pulling out the pipe section leaving behind the removable end plate and thereby installing porous displacement piles which allows dissipation of the excess pore-water pressures horizontally to the porous displacement pile, in which the excess water flows out vertically to the ground surface, and (v) the length of the drainage path is reduced to half the spacing between adjoining porous displacement piles, allowing rapid consolidation resulting in increase in density. Installing the porous displacement piles in the layer of loose to medium dense sand layer results in the instantaneous increase in its density.

3 Claims, 10 Drawing Sheets

RAPID CONSOLIDATION AND COMPACTION METHOD FOR SOIL IMPROVEMENT OF VARIOUS LAYERS OF SOILS AND INTERMEDIATE GEOMATERIALS IN A SOIL DEPOSIT

TECHNICAL FIELD

This application is for applying for a utility patent in a technical field which includes civil engineering and geotechnical engineering for soil densification of layers of soils and intermediate geomaterials in a soil deposit. This specification/description is complete-in-itself. This invention is not sponsored or supported by federally sponsored research or development or by any other organization. This invention has been conceived, developed and completed independently by the inventor, Dr. Ramesh Chandra Gupta, Ph. D., P. E, President and Sole Owner of SAR6 INC. The inventor, Dr. Ramesh Chandra Gupta is a Citizen of the United States of America.

BACKGROUND OF INVENTION

Sand drain technique to strengthen the weak soils (Kennedy and Woods, 1954) has been in wide use from long time. Bowles, 1988 summarized the method of Sand Drains to strengthen and consolidate clayey soil layers which cannot support the load of the embankment or foundation structures. A circular casing or mandrel is driven vertically into a soft clayey layer to the required depth. The soil in the casing or mandrel is removed and the hole is backfilled with clean sand under gravity to form a loose layer of sand column in the surrounding weak clayey soil. The mandrel or casing is then removed by pulling it out of the ground. The embankment is then constructed on top of the ground surface up to the full height in stages. If the full height of embankment is 5 meters, it will develop excess pore-pressures to about 49 kPa (7.1 psi). After allowing sufficient time for consolidation, to dissipate the developed excess pore pressures generally up to 90% consolidation, either embankment if it is for highway left in place or otherwise the embankment is excavated and the required structure, such as buildings or air ports, oil storage tank etc., is constructed on original ground or at some depth below the original ground. Depending on the horizontal spacing of sand drains and coefficient of consolidation of in-situ clays, the time for consolidation could vary from six months to a year or more. Recently, PVC drains or wick drains have generally replaced the sand drains.

Mars (1978) introduced another method in which a probe pipe with a partially openable valve in a form of two halves of a cone at its end is driven by a vibratory probe, assisted by liquid jets to erode the in-situ soils around and below the probe and to facilitate its penetration to the design depth. Vibratory probe is very light in weight with very low centrifugal force, and therefore, either pre-auguring or liquid jets to erode the soil is required. Liquid jet pipes are the integral part of the probe pipe which pass through at the end of probe pipe in to the in-situ soil. The probe has bands around the probe at some spacing vertically. When the probe pipe is being penetrated in to the ground, the end valve remains in closed position, and the pebbles, stones etc. is filled in the probe pipe by gravity through a chute achieving a very loose density. When the probe pipe is pulled out of the ground, the partially openable valve opens and allows the pebbles, stones or sand drop through its narrow opening which appears to be less than 25% inside area of the probe pipe, thus forming a column of pebbles, stones etc. with its area of cross-section less than 25% inside area of the probe pipe, because before additional pebbles etc. drop in, in the remaining outside area of probe pipe and bands, the in-situ soil consisting of either clay or sand will quickly run and cave-in. Therefore, the pebbles etc. dropped under gravity will only be able to form a column in very loose condition with the area of cross-section significantly smaller than the inside area or outside area of the probe pipe. No embankment to surcharge the area to compact it, has been described in this method (Mars, 1978). Mars (1978) method was developed to compact an area of soil having initial low bearing strength, such as an alluvial or sandy area or an area of hydraulic fill. Many organizations do not allow vibratory probes to drive pipes in clayey soils. In sand drain technology, embankment is placed on the site area to consolidate and densify the area, which also results in densification of sand drains which consists of loosely filled sand, but Mars (1978) method does not use the embankment to be built over the area where the loosely filled pebbles etc. have been filled in the vertical holes. Therefore, Mars method could loosen the area in place of densifying it.

The invention in this application comprises of a rapid consolidation and compaction method (RCCM) to produce rapid consolidation of the layer of clayey soil resulting in increase of its density and consistency. The RCCM comprises (i) first driving a hollow pipe section to some depth to minimize heave at the ground surface or above the layer of soil requiring improvement, (ii) driving a displacement pile consisting pipe section with a removable or detachable end plate after filling and compacting the sandy material in the pipe section closed with the removable end plate, to the required depth in the layer of clayey soil through inside the hollow pipe section previously driven, (iii) because the pipe section with detachable end plate performs as a displacement pile displacing the in-situ clayey soil and creating high excess pore-water pressures, which are expected to be generally in a range of 100 to 800 kPa, but could be as high as 2500 KPa; (Note: values of excess pore-water pressures shall depend on the consistency and depth of the clay below the ground surface), (iv) before pulling out the pipe section out of the ground, a heavy weight is placed top of the compacted material inside the pipe section, (v) now remove or pull out the pipe section out of the ground; the heavy weight continues to push down the column of compacted sandy material and prevents any necking to form in the column of the compacted material, (vi) the detachable or removable end plate opens the 100 percent of the inside area and thus forms a column of compacted sandy material equal to inside area of the inside area and weight further imposes the downward force which further laterally is displaces to occupy space equal to the outside area of the pipe section, (vii) thus, the column of compacted sandy material behaves as a porous displacement pile embedded in the clayey soil and allows the excess pore-water pressures to first develop and then rapidly dissipate them causing excess pore-water to flow first horizontally to the porous displacement pile and then vertically flow through it to the ground surface or to a sandy layer above or below the porous displacement pile, and (v) when the porous displacement piles adjoining to the first one in a grid pattern are installed, the length of the drainage path is further reduced to half the spacing between adjoining porous displacement piles, allowing rapid consolidation of the layer of clayey soil resulting in its increase of density and consistency sufficiently enough to support loads of the required structure, such as pavement, civil structure, airport or oil storage tank, etc. Installing the porous displacement piles in the layer of loose to medium dense sand layer in a grid pattern results in the instantaneous increase in its density. Therefore, the rapid consolidation and compaction method (i.e., RCCM) presented in this application as an invention, improves and increases the density of all types of soils and intermediate geomaterials to support loads of the structures of a project. The sandy material is compacted to relative density equal or greater than 70% or even up to 100% inside the pipe section, depending on the requirement of supporting loads of the structure and also the subsurface soil conditions. The maximum value of the excess pore-water pressures is on the surface of the cone penetrometer and the value of excess pore-water pressures rapidly reduces with radial distance from the cone penetrometer. Same trend of excess pore-water distribution around porous displacement piles is expected to occur during penetration of the porous displacement piles. The maximum excess pore-water pressures near the face of the porous displacement shall quickly dissipate through the porous displacement pile as the length of the path of flow is zero or very short distance from the zone of higher excess pore-water pressures. When adjoining porous displacement piles are installed, the length of the path for flow shall reduce to half the spacing between adjoining porous displacement piles. For example, if the center to center spacing of porous displacement piles is say, 4 times their radius of the porous displacement piles, then the distance between faces of the porous displacement piles shall be only three times the radius, but from the mid-point between the porous displacement piles shall be only 1.5 times the radius, facilitating very quick dissipation of the excess pore-water pressures. In an earth dam of 30-meter height, excess pore-water pressures to the extent of 290 $kNm^2$, are developed in clay zone and therefore, it is required that the sandy material to satisfy a filter criterion to prevent migration of fine particles of clayey soil and also to allow free flow of the excess pore-water pressures. In view of this, the particle size distribution of the compacted sandy material in the porous displacement piles, will also be designed to satisfy the filter criteria (Prakash and Gupta, 1972).

In many cases, it may not be practical to pull out the pipe section out of the ground. Therefore, porous reinforced concrete piles with or without prestress, or porous pipe section with the end plate, or pipe section with small holes and the end plate, filled by the compacted sandy material shall also installed through inside the non-displacement piles and shall be used as the porous displacement piles, if (1) drivable by a pile driving hammer into the soil without exceeding allowable driving stresses, (2) allow free drainage and flow of water and prevent migration of fine soil particles of clays and silts or fine sand, (3) the holes in the tube or pipe section need to be quite small so as to retain sandy material during compaction in the pipe section. These porous displacement piles will not require pulling out of the pipe section out of the ground and the installation will become faster, with no noise which may happen during pulling the pipe section.

In the invention presented in this application, constructing the embankment to create uniform excess-pore water pressures in clayey soil is not required, as much higher excess pore-water pressures are likely to develop by penetration of porous displacement piles.

SUMMARY OF INVENTION

(a) Technical Problem with Existing Geotechnical Methods for Soil Improvement As explained above, widely used methods for consolidation and for densifying a layer of clayey or silty soil are sand drains or wick (PVC) drains, which have been used for more than 50 years. Other methods such as osmosis etc. are rarely used. Recently, several methods have come up which do not increase the consistency or density of the layer of clayey or silty soils, but increase the load capacity by installing (a) Geopiers or (b) Stone Columns or (c) Jet Grouted Columns or (d) Lime or Cement Mixed Columns with clayey soils installed in a drilled hole by drilling and auguring (Shaefer et al., 2016). Even bottom feed stone columns, which do not use drilled holes does not succeed in improving the density of the layer of the clayey soils, probably because of very strong vibrations by the vibratory probe disturbing matrix of clayey soils and then allowing inflow clayey soils in them. When holes are excavated using the above methods, a considerable amount of excavated material spreads around the site of the project, which has to be properly disposed of to prevent any environmental problem. Reinforced Concrete Piles or H-Piles overtopped by small footing and several layers of geotextile separated by sandy material have been used to support the loads of the embankment on soft to very soft soils. All these methods do not the density and/or increase consistency of soft to very soft soils, but support the weight of road embankment directly, without permitting load on the soft clay layer. These methods are very costly involving millions of dollars per mile (one mile=1.6 Kilometer). There are no historical case histories for the above newer technologies, which may demonstrate their successful long-term behavior.

For compaction of layers of sandy materials in a soil deposit, there are several methods, which are being used, such as dynamic deep compaction by dropping a weight from the selected height, Vibro-replacement and Vibro-floatation, Geopiers using rammed gravelly materials, stone-columns as bottom feed or top feed, etc. The vibro-floatation or stone column equipment has frequency of 3000 rpm, centrifugal force of 30000 kg, weight of 9000 kg, height of about 2.5 meter, and inside diameter of about 38 cm. The vibro-floatation and stone column vibro-equipment has a central hole through which water jets are jetted to erode soil when subsurface soil conditions are such that vibration alone cannot penetrate into soil any further or when penetration rate becomes very slow. The rapid consolidation and compaction method using porous displacement piles is a new method which can be used successfully to densify the sandy materials in which excess pore-water pressures do not develop or if develop then dissipate as fast as these are generated. The RCCM will generally require readily available instruments and machinery such as cranes and pile driving hammers etc., pullers, surface or plate vibrators, which could be available on rent or for leasing at most places or for sale from manufacturers.

(b) Solution to Problem and Advantageous Effects of Invention

As explained above, the rapid consolidation and compaction method is installed to increase the density of both sandy and clayey materials. Since the sandy material is very economical with much lower cost as compared to jet grouted columns, columns of cement or lime mixed with clayey material or Geopiers, the cost of using the rapid consolidation and compaction method shall be much lower and could save millions of dollars on a big project. The rapid consolidation and compaction method shall densify the (i) very soft to soft cohesive soil to stiff or very stiff cohesive soil, (ii) medium stiff cohesive soil to stiff or very stiff cohesive soil, (iii) stiff cohesive soil to very stiff cohesive soil, and (iv)

very stiff cohesive soil to hard or very hard soil cohesive soil, depending on the selected spacing between the adjoining porous displacement piles and relative density of compacted sandy soil in the porous displacement piles. Similarly, the rapid consolidation and compaction method shall compact sandy soil from (i) very loose (relative density less than 15%) to medium dense (relative density between 35 and 65%), (ii) loose (relative density between 15 and 35%) to medium or dense sand (relative density between 65 and 85%), (iii) from medium dense to dense sand, and (iv) from dense to very dense (relative density greater than 85%), depending on the selected spacing between the adjoining porous displacement piles and relative density of compacted sandy soil in the porous displacement piles. When densification to higher densities of in-situ soils is required then the relative density of the sandy material in porous displacement piles more than 70% even up to 100% may be selected for the compacted sandy material in the displacement pipe section with removable end plate, which after installation is pulled out of the ground to form a porous displacement pile. Both the densified in-situ clayey silty soil and in-situ sandy soil in a layer to the selected depth below ground surface shall be capable to provide support to the foundation of a structure with adequate bearing capacity and minimum settlements. During construction of the structure on densified in-situ soil, if any excess pore-water pressure develops, shall quickly dissipate and small settlement shall occur before the structure reaches full height. No embankment as required for the sand drains or PVC drains and waiting for consolidation to occur for 6 months to more than a year shall be needed when the RCCM has been selected. Therefore, progress of construction shall become very fast, which is very important for highway projects for expansion or widening of existing roads and highways or also for support of the foundations of various structures.

DETAILED DESCRIPTION OF INVENTION

Figure 1A:
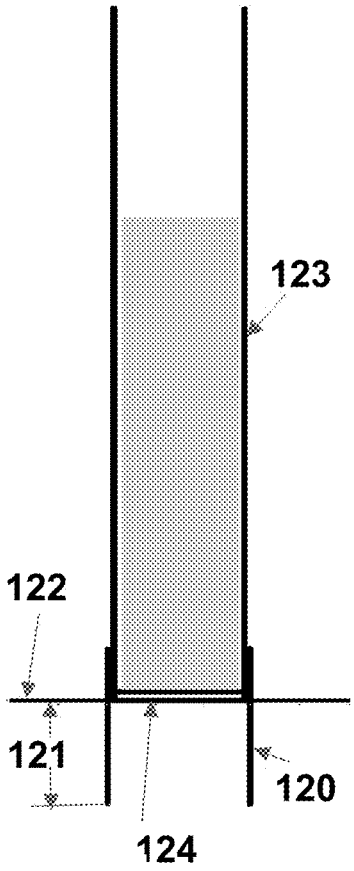
FIG. 1A: A typical detail showing installed non-displacement pile (120) and pipe section (123) with detachable or removable end plate (124) and filled with compacted sandy material.

The main motivation for the invention of the rapid consolidation and compaction method (RCCM) is to develop a method for soil improvement which can densify a layer of the soil or the intermediate geomaterial (IGM) in a soil deposit. Cohesionless soils are defined as having $N_{60}$ less than 50 blows/0.3 m, whereas cohesionless Category 3 IGMs are defined as having $N_{60}$ greater than 50 blows/0.3 m (AASHTO, 2012). Cohesive soils are defined as having undrained shear strength less than 0.25 $MN/m^2$, whereas cohesive IGMs Category 1 are defined as having undrained shear strength greater than 0.25 $MN/m^2$ (AASHTO, 2012). The invention in this application comprises of a rapid consolidation and compaction method (RCCM) to produce rapid consolidation of the layer of clayey soil resulting in increase of its density and consistency. The RCCM comprises (i) first driving a hollow pipe section to some depth to minimize heave at the ground surface or above the layer of soil requiring improvement, (ii) driving a displacement pile consisting pipe section with a removable or detachable end plate after filling and compacting the sandy material in the pipe section closed with the removable end plate, to the required depth in the layer of clayey soil through inside the hollow pipe section previously driven, (iii) because the pipe section with detachable end plate performs as a displacement pile displacing the in-situ clayey soil and creates high excess pore-water pressures, which are expected to be generally in a range of 100 kPa to 800 kPa, but could be as high as 2500 KPa (Note: values of excess pore-water pressures shall depend on the consistency and depth of the clay below the ground surface. Pore-water pressures in the range between 260 psi (1793 kPa) and 400 psi (2758 kPa) were recorded in Cooper Marl. Peuchen et al. (2010) recorded pore-water pressures in the range between 50 kPa (7.25 psi) and 800 kPa (261 psi) during piezocone penetration in heavily overconsolidated cohesive soil), (iv) before pulling out the pipe section out of the ground, a heavy weight is placed top of the compacted material inside the pipe section, (v) while removing or pulling out the pipe section out of the ground, the heavy weight continues to push down the column of compacted sandy material and prevents any necking to form in the column of the compacted material, (vi) the detachable or removable end plate opens the 100 percent of the inside area and thus forms a column of compacted sandy material equal to inside area of the inside area and weight further imposes the downward force which further laterally displaces compacted sandy soil to occupy space equal to the outside area of the pipe section, (vii) thus, the column of compacted sandy material behaves as a porous displacement pile embedded in the clayey soil and allows the excess pore-water pressures to first develop and then rapidly dissipate them causing excess pore-water to flow first horizontally to the porous displacement pile and then vertically flow through it to the ground surface or to a sandy layer above or below the porous displacement pile, and (v) when the porous displacement piles adjoining to the first one in a grid pattern are installed, the length of the drainage path is further reduced to half the spacing between adjoining porous displacement piles, allowing rapid consolidation of the layer of clayey soil resulting in its increase of density and consistency sufficiently enough to support loads of the required structure, such as pavement, civil structure, airport or oil storage tank, etc. Installing the porous displacement piles in the layer of loose to dense sand layer in a grid pattern results in the instantaneous increase in its density. Therefore, the rapid consolidation and compaction method (i.e., RCCM) presented in this application as an invention, improves and increases the density of all types of soils and intermediate geomaterials (whether, loose condition or dense, soft or very stiff, to support loads of the structures of a project. The sandy material is compacted to relative density equal or greater than 70% or even up to 100% inside the pipe section, depending on the requirement of supporting loads of the structure and also the subsurface soil conditions. When footing of a structure is constructed on the soil which has been densified by the RCCM, weight of the structure further creates excess pore-water, which also gets rapidly consolidated and footing may continue to settle uniformly by very small magnitude as the substructure and superstructure is being constructed, but after completion of the superstructure, there shall be hardly any settlement and if any, shall occur uniformly. After completion of installation of porous displacement piles, the ground surface soils may be compacted by passes of compaction roller, or sheep foot roller etc., by general contractor, if needed as per project drawings.

Figure 1B:
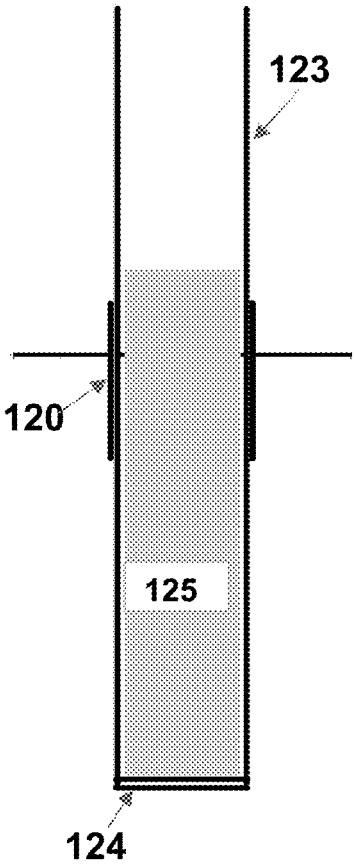
FIG. 1B: A typical detail of pipe section (123) with detachable or removable end plate (124) driven to design depth.
Figure 1C:
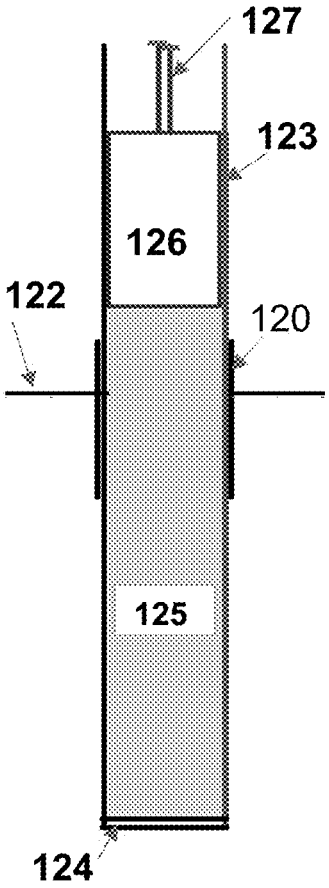
FIG. 1C: A typical detail showing a hammer or weight (126) placed on top of the compacted sandy material (125), prior to pulling the pipe section (123) out of the ground.
Figure 2A:
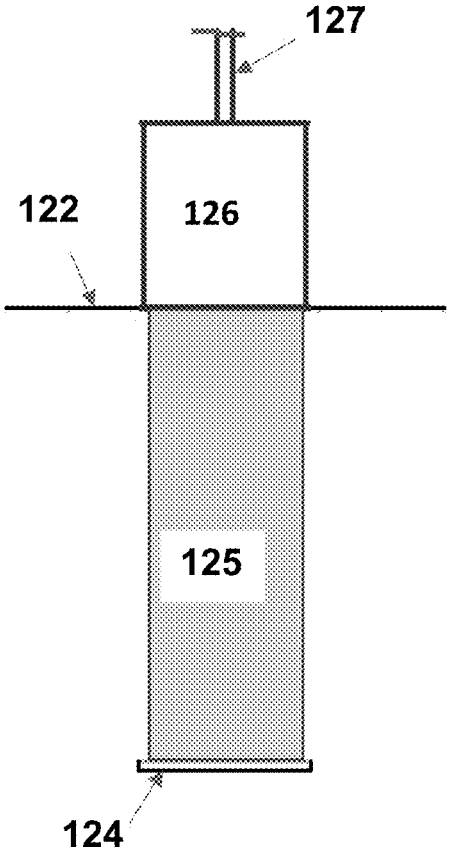
FIG. 2A: A typical detail of the column of compacted sandy material acting as a porous displacement pile (125) after the pipe section has been pulled out of the ground and the hammer or weight (126) still resting on the porous displacement pile (125).
Figure 2B:
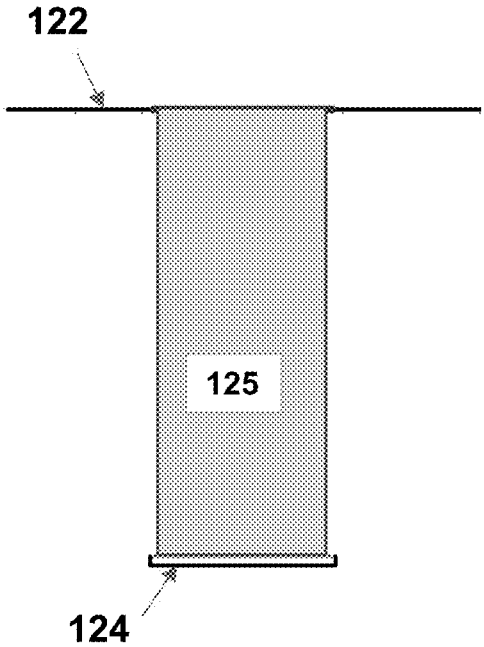
FIG. 2B: A typical detail of completion of installation of the porous displacement pile (125), with end plate (124) sitting under it.

For the above process, a hollow pipe section (120) is driven into soil to the selected depth (121) to minimize the heave at the ground surface. A hollow pipe sections have very small annular area compared to its outside or inside area, and therefore, for geotechnical purposes, the hollow pipe piles are called non-displacement piles. Similarly, piles consisting of HP-section and channel sections etc. are called non-displacement piles. After the non-displacement pile (120) has been driven into the ground, as shown in FIG. 1A and FIG. 1B, a displacement pile, consisting of the pipe section (123) with a removable end plate (124) and filled with compacted sandy material (125) is driven into the layer to be densified. Since the end plate is attached at the bottom of the pipe section, when driven into ground, the pipe section with closed end displaces the in-situ soil reducing the void volume of the in-situ soil or develops excess pore-water pressures and occupies its space; and thereby eventually densifies it. After placing a weight or hammer (126) on the top of sandy material as shown in FIG. 1C, and the pipe section is pulled out from the ground, leaving behind the detachable or removable end plate at the bottom of the column of the compacted sand, as shown in FIG. 2A. The weight or hammer (126) helps to continue pushing the column of sandy soil downwards and even help push sand in the column laterally to occupy the space left by the thickness of pipe section. Few drops of weight after raising it by a few centimeters further helps in displacing sandy material in the voids created by pulling out the pipe section (123). Thereafter, the non-displacement pile (122) is also pulled out and a few drops of the weight or hammer further helps in displacing and compacting sandy material (125) in the voids created by pulling out the non-displacement pile (120). In this way, the porous displacement pile (125) consisting of compacted sandy material, as shown in FIG. 2B, is installed into the ground in the depth, the densification or soil improvement is needed.

The hollow pipe or tube section could be round, square or rectangular or any shape available or made in the industry. Sometimes, two angle sections or two channel sections welded together could also be used as a hollow pipe section. When such sections are attached with a detachable or removable end plate and used as a displacement pile to be driven in to ground, then for geotechnical purposes, it is called a displacement pile as it displaces the soil by occupying its place. When these sections without any end plate at its bottom (i.e. a hollow section) is driven in to ground then for geotechnical purposes, it is called a non-displacement pile. The sandy material can be compacted inside the pipe section at the location where it is to be driven or at the ground other than the location where it is be driven or otherwise in the pipe section after being driven in to ground if the ground below it is sufficiently dense to limit settlement to keep the end plate intact at the bottom of the displacement pile.

The non-displacement pile is driven into the ground first, in order to minimize heave at the ground surface or at the top the layer which is to be densified. Ideally, during driving the displacement pile, there should not be any heave of the ground surface to achieve maximum lateral displacement of the soil by the porous displacement pile, in order to achieve maximum densification. That is why to minimize heave, first a non-displacement pile is driven to selected depth and then the displacement pile is driven through the non-displacement pile. If this step of driving displacement pile through a non-displacement pile is omitted and displacement pile is driven directly, due to economics or for any other reason such as not very practical at a particular site, etc., or when non-displacement pile has not been driven to adequate depth to minimize or prevent heave, then although full densification of in-situ soil would not occur because of some heave at the ground surface. In such cases, the amount of densification will be less as the volume of the in-situ soil displaced by the displacement pile will be sum of the reduction of voids in the in-situ soil plus the volume soil which heaved at the ground surface or at the top of the layer to be densified. The overburden soil above the depth of the bottom of the non-displacement pile (120) acts to prevent or minimize the heave at the ground surface to a reasonable limit, when the weight of the overburden soil above the bottom of the non-displacement pile (120) is sufficient enough to prevent heave at the ground surface. According to the presently available research, the overburden depth between 7 to 10 times or more may be sufficient to limit heave at the ground surface, depending upon the soil conditions. However, not enough or substantial research is available at the present, to predict the reasonable depth (121) in different types of soils at various densities or consistencies to prevent or minimize the heave at the ground surface when a displacement pile is being driven into the ground. Sufficient research shall be developed to predict the reasonable depth (121) in different types of soils at various densities or consistencies, when the projects involving ground improvement using the RCCM are being implemented.

The sandy soil (125) is filled in layers in the pipe section (123) and each layer compacted by a specified number of drops of a hammer or a weight (118) to achieve a specified dry density or relative density. The connecting pipe or rod (127) connects the weight or hammer to a boom of crane or to a pile driving hammer system (not shown in the FIG. 1C). Alternatively, either the sandy soil can also be filled in layers and then the hammer or the weight (118) placed on top of each layer, after which vibrated by attaching a surface vibrator on the sides of the pipe section (123) or the vibratory probe/weight is placed on top of each layer for densifying the sandy soil to the specified dry density or relative density. The pipe section (123) with detachable or removable end plate is generally maintained vertical while filling sandy material in it and compacting it.

The density of the compacted sandy material inside the pipe section (123) should generally be based about 70% relative density, because this is the requirement which is generally followed for compacting embankments. When densification of stiff to very stiff clays to hard clayey soils or medium dense or dense sand to very dense sand is required, then relative density of compacted sandy material in the pipe section to about 70% or greater than 70% and even up to 100% may be more appropriate. In earth quake zones and over faults, or under atomic power plants, even very stiff clays or dense sands may require further densification, in such cases, the relative density of more than 70% to even up to 100% for the column of compacted sandy soil to perform as porous displacement pile could be specified. However, when very soft clays or soft clays to be densified to medium stiff clays or loose to very loose sand is to be densified to medium dense sand, then relative density requirement could be relaxed, if structural support requirement of the site could be met by lesser relative density of the porous displacement piles consisting of compacted sandy material. The relative density of medium dense sand varies from 35 to 65%. If the site where its subsurface layers need to be densified to the relative density equivalent to medium dense sand condition to meet the structural foundation support or overall ground support of the site, then it may be sufficient to install porous displacement piles consisting of columns of sandy material to relative density necessary for medium dense sand, therefore then in such cases, the sandy soil in the pipe section (123) shall need to compacted to achieve medium dense condition. Therefore, the sandy soil in pipe section (123) shall need to be compacted to achieve the medium dense or to dense or very dense condition according to requirements at the project site. Selecting an appropriate spacing and diameter of the porous displacement piles is also important to determine how much porous displacement piles will displace and compress the in-situ soil to densify it. To densify to a greater relative density of sandy soil in the pipe section (123), few extra drops of hammer shall be needed on each layer of the sandy soil in the pipe section (123), which is rather easy, less time consuming and only few extra dollars. The porous displacement piles with relative density greater than the density of densified in-situ soil densified by the rapid consolidation and compaction method, shall work as a reinforcement to share more load of an embankment or foundation of a structure than that by the densified in-situ soil, thereby reducing the total settlement of the structure and the embankment. All these technical points should be considered in design of the porous displacement piles for each project.

Figure 3A:
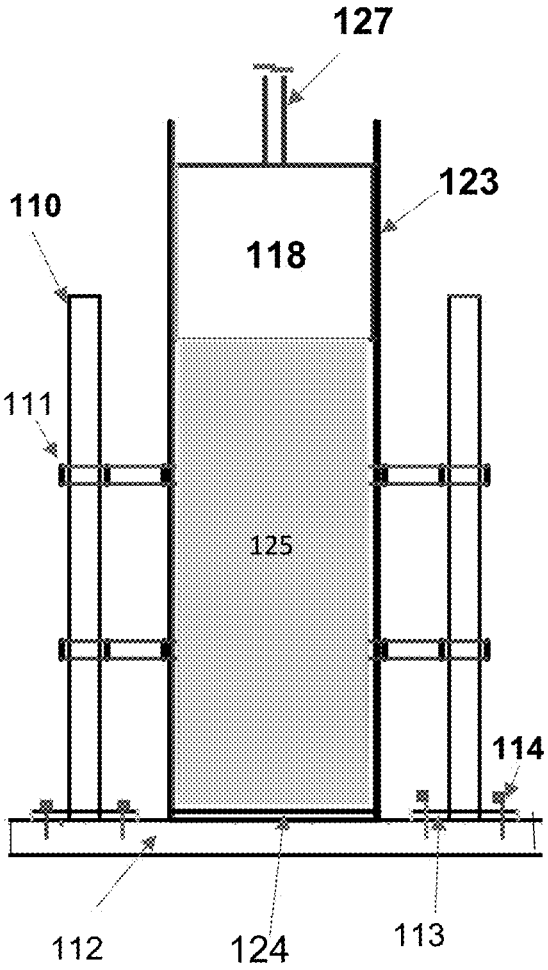
FIG. 3A: A typical detail of a setup to provide lateral support to the pipe section (123) during compaction of the sandy material in it.
Figure 3B:
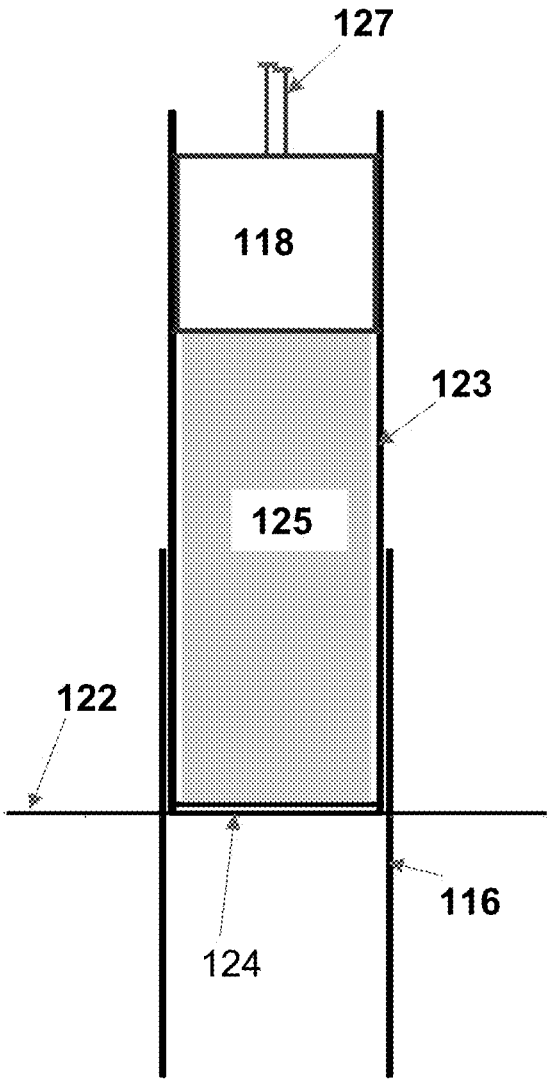
FIG. 3B: Another typical detail of a setup to provide lateral support to the pipe section (123) during compaction of the sandy material in it.

FIG. 3A shows a typical example for the support system to maintain the pipe section (123) in vertical position during compaction of sandy soil in the pipe section, and therefore, it is desirable that the pipe section is laterally supported by horizontal braces (111). The horizontal braces are attached to vertical column sections (110) on either side. The column sections are supported on a concrete pad or a plate and fastened into it by nails or bolts (114). Alternatively, the pipe section (123) as shown in FIG. 3B is maintained vertical by slipping it into another pipe section (116) which has already been driven into ground to sufficient depth to remain laterally stable; this pipe section (116) also protrudes out of the ground to maintain the pipe section (123) vertical and laterally stable while compacting the sandy material in it. The lateral support system shall be especially designed at each project depending on the length and size of the pipe section and soil conditions, at which time these typical examples shall also be considered. When the soil layers under water in a river or ocean are to be densified from a boat or floating platform or a ship, the lateral support system shall be specially designed with discussion with their owners.

There are various types of hammer/weight available to drop on the sandy soil placed inside the pipe section (123) for densifying the sandy soil; any of these hammers/weights and their attachments can be used when considered appropriate according to specifications or brochures of the manufacturers of the equipment. There are many types of surface vibrators available in the industry which can be used around the pipe to densify sand inside the pipe section (123), when the weight or hammer has already been placed on top of the sandy material to compact it, or placing the vibrator on top of a plate or vibrating weight to densify sandy soil inside the pipe; any of the available systems if appropriate can be used following the manufactures' brochure or specification. There are many types of pile driving hammers including vibratory hammers available in the industry to drive a non-displacement or displacement pile; any of these driving hammers can be used when considered appropriate. There are many types of pile pipe pullers including vibratory pullers or pullers with hydraulically operated jaws to grab the pile available in the industry to pull the non-displacement or displacement pile out of the ground; any of these pullers can be used when considered appropriate. The attachments between the pipe section or rod (127) and the crane by U-Bolts or hooks etc., or attachment between the puller and the pipe section (123) or the surface vibrator to the pipe section (123) or plate vibrators etc. shall be in accordance with the manufacture's specification and brochure. When the pipe section is being driven, all attachments of pile driving hammer shall be in accordance with pile driving specifications. Many organizations do not allow vibratory hammers to drive non-displacement or displacement piles in clayey silty soils, because it is considered that vibration remolds and disturbs the matrix and lock-in-stresses of clayey silty soils.

Figure 4A:
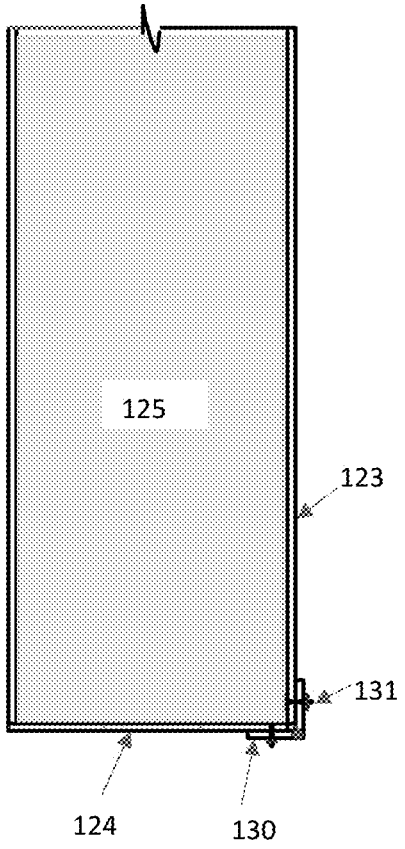
FIG. 4A: A typical detail of the hinged connection connecting pipe section (123) to the removable and detachable end plate (124).
Figure 4B:
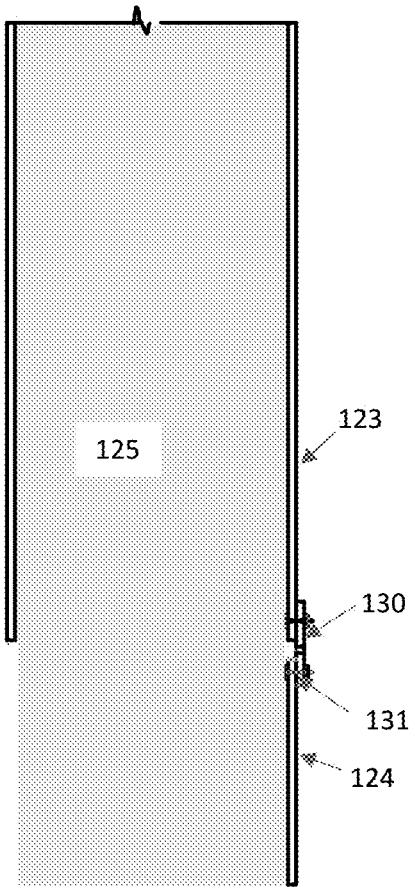
FIG. 4B: A typical detail showing the end plate becoming vertical during pulling the pipe section (123) out of the ground.
Figure 5A:
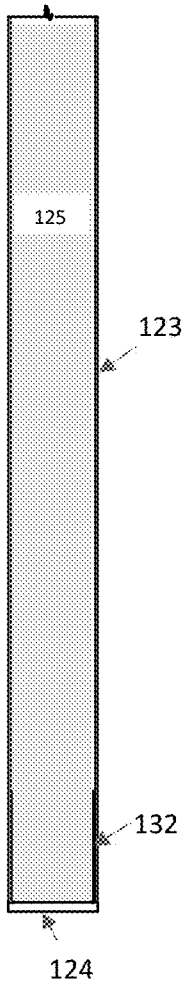
FIG. 5A: A typical detail of the pipe section (123) with a removable and detachable short pipe (132) inserted inside the pipe section (123) where the short pipe (132) is attached to end plate (124).
Figure 5B:
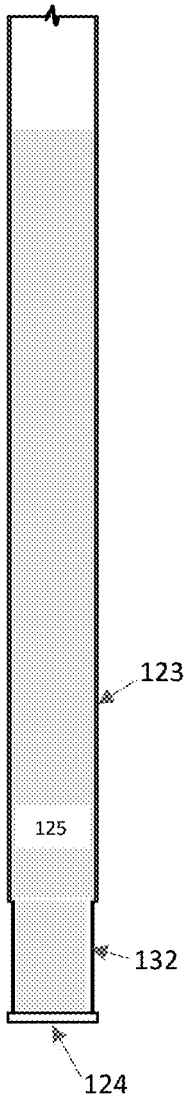
FIG. 5B: A typical detail showing the removable and detachable short pipe (132) and end plate (124) left behind while pulling the pipe section (123) out of the ground.
Figure 5C:
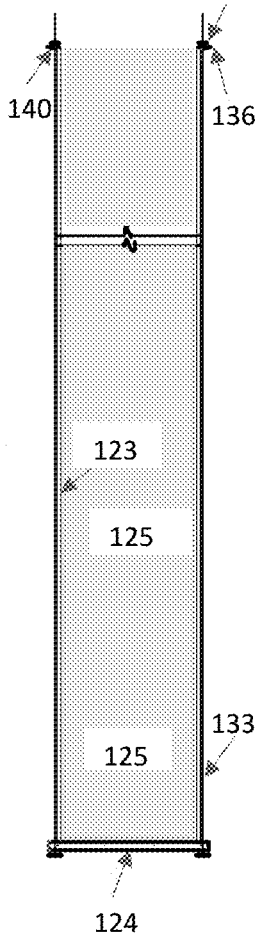
FIG. 5C: A typical detail showing the removable end plate (124) attached to the connecting rods (133); the connecting rods (133) which are fastened by bolts (13%) to the top of the pipe section (123).
Figure 5D:
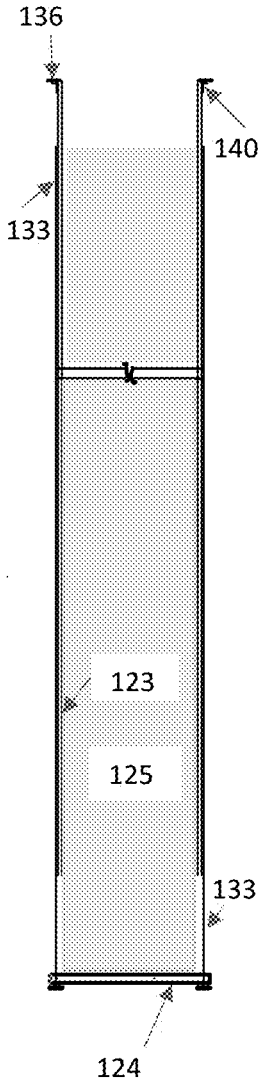
FIG. 5D: A typical detail showing the connecting rods (133) and removable end plate (124), which after removing the bolts (135) are left behind during pulling the pipe section (123) out of the ground.

Few typical examples of detachable or removable end plates are shown in FIG. 4A, FIG. 4B, FIG. 5A, FIG. 5B, FIG. 5C, FIG. 5D, FIG. 6A and FIG. 6B. FIG. 4A shows a detachable end plate which is attached by bolts (131) to a hinge connection (130) on one end to the pipe section (123); during driving the pipe section (123), the detachable end plate (124) remains attached to the bottom, but when pipe section (123) is pulled out of the ground, the detachable end plate (124) connected by the hinge (130) becomes vertical as shown in FIG. 4B, assisting pulling of the pipe section (123) out of the ground, but maintaining the compacted sandy material in place. FIG. 5A shows a short piece of pipe section or a snug corrugated pipe (132) positioned inside the pipe section (123) but attached to the end plate (124). During driving steadily and carefully, a short pipe section (132) and end plate remains in position at the bottom of the pipe section (123), but when the pipe section (123) is pulled out of the ground, the end plate (124) attached to the short pipe or snug corrugated pipe section (132) is left behind in the ground, as shown in FIG. 5B. As an additional option, the section (132) can also be attached by thin aluminum rivets to pipe section (123), but these rivets shall break when weight of compacted sand material exert its weight to break the aluminum rivets. FIG. 5C shows the end plate (124) attached to a plurality of connecting rods (133) which are vertically installed upwards on diametrically opposite locations outside the pipe section (123) and held by bolts (135) near the top of the pipe section (123). The connecting rods (133) pass through a circular plate (136) supported by a plurality of angle sections (140) and fastened by bolts (135) near the top of pipe section (123). During driving the displacement pile, the end plate (124) remain attached, but before pulling the pipe section (123), the bolts (135) are removed and when the section (123) is being pulled out of the ground, the detachable end plate (124) is left behind in the ground as shown in FIG. 5D. In this way the compacted sandy material is left in place forming a porous displacement pile. At each project, the removable or detachable end plate may be especially designed depending on soil conditions and length and size of the displacement piles at which time the above typical examples shall also be considered.

Figure 6A:
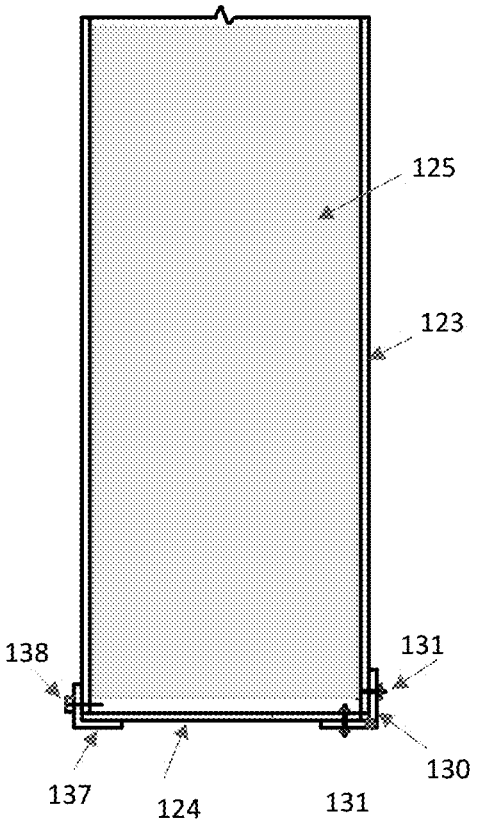
FIG. 6A: A typical detail of removable end plate (124) connected to pipe section (123) with a hinge (130) on one side and on opposite side by an angle (137) which is also bolted to the pipe section (123), for lifting the pipe section (123) filled with compacted sandy material, to a location where it is to be driven into the ground.
Figure 6B:
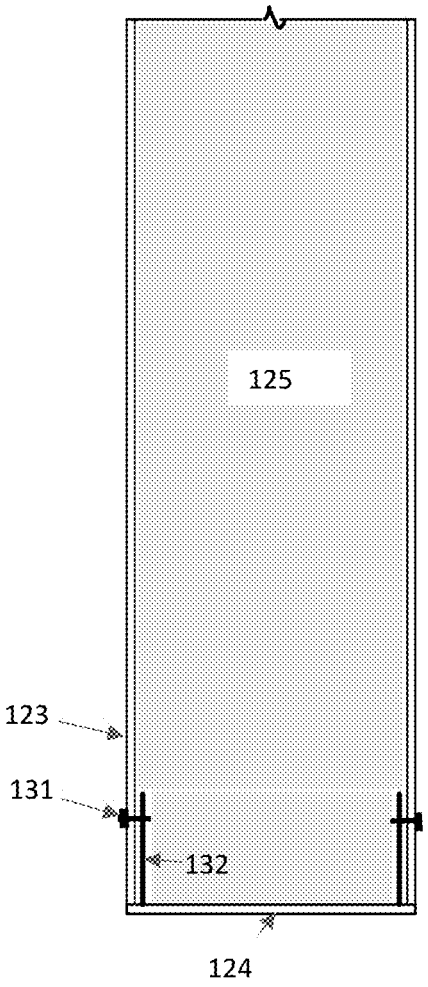
FIG. 6B: A typical detail of pipe section (123) bolted to short pipe section (132) which is attached to the end plate (124) for lifting the pipe section filled with compacted sandy material to a location where it is to be driven into the ground.

The above details are applicable when the field operations to compact the sandy material are being performed at the location where the pipe section (123) is to be driven. When the sandy material is being compacted in the pipe section (123) at some other location and then to be transported to the selected location where it is to be driven in to the ground, the additional attachments to end plate (124) are required. In such cases, the detachable plate arrangement of FIG. 5A and FIG. 5B will still work, but some improvement in FIG. 4A, FIG. 4B, FIG. 5A and FIG. 5B will be needed. As shown, in FIG. 6A, a plurality of angle sections (137) is attached by bolt to the pipe section (123) on diametrically opposite sides to each other and also to the hinged connection (130). FIG. 6B shows the short pipe section (132) attached by a plurality of bolts to pipe section (123) on diametrically opposite sides to each other. When the pipe section (123) has been transported to selected location for driving, it is necessary to remove bolts (138) and slip out the angle sections (137). Similarly, bolts (131) as shown in FIG. 6B has to be removed, when end plate is touching the ground, after which the crane slings be loosened to lower down the displacement pile on the ground.

For pulling the pipe section (123) successfully out of the ground, weight of the weight or hammer (126) kept on top of the compacted sandy material, is designed based on the side frictional resistance developed between the compacted sandy material inside pipe section (123) and side frictional resistance between outside of the pipe section (123) and in-situ soil around it and also any suction force exerted by the in-situ soil on the end plate during pulling of the pipe section. Similarly, weight of the weight or hammer and number and height of drops is designed to achieve the specified density. Although, structural members described for non-displacement and displacement pile consist of circular section as shown in the text and Figures, any non-common section of hollow rectangular, or elliptical section or any other non-common section will work with the RCCM and can be used on demand by a client. During driving the non-displacement or displacement pile, sometimes, it becomes important to limit noise and vibrations, in such cases, heavy hammers with very small height drops or hydraulically pushing the piles into the ground may become important so as to minimize or limit the damage or risk to adjoining structures. To monitor settlement of the adjoining structures, the settlement readings both at the structure and at the ground surface and at some depth in the ground may also be made. Also, it may be advisable to perform wave equation analyses for driving the pipe section (123) with a selected hammer (Pile Dynamics, Inc., 2005). To determine amount of improvement and increase in density of the improved in-situ soils, the subsurface exploration using the in-situ testing methods and laboratory tests on the extracted samples from the in-situ soil may also be performed before and after installation of the porous displacement piles.

The porous displacement pile consisting of the column of compacted sandy material besides densifying and improving soil around it, has another important function to perform, which is to prevent the passage or migration of clay or silty particles into the compacted sandy material while allowing free flow of water through the column of the compacted sandy material in order to dissipate the excess pore-water pressure. The gradation of the compacted sandy material to perform a function of a filter to limit migration of the fine material and allow free flow of water shall be designed based on the design criteria for filters or chimney filters used in earth dams or earth and rockfill dams, using the Terzaghi's criteria with or without some modification made by several organization such as US Bureau of Reclamation, etc. (Prakash and Gupta, 1972). The sandy material may consist of mixture of sand and little quantity of small gravel, but should satisfy requirements of allowing free flow of water and to prevent migration of fine particle of in-situ soil into the column of compacted sandy material. The sandy material should not contain more than specified quantity of fine particles in order to maintain its property of free flow of water. Generally, well graded clean sands have been used in sand drains; the same type of material, when meeting the filter Criteria, could be used for the porous displacement piles.

Briefly Terzaghi's Criteria is briefly described as below:

(1) Piping or Migration of particles criteria: $D_{85(Base)}$ represents the particle size that must be retained. $D_{15(Filter)}$ is representative of average pore size. Filter to trap particle size larger than about 0.1 $D_{15(Filter)}$ $D_{15\ (filter)}$<4 to 5 $D_{85\ (Base)}$ Permeability or Free Flow Criteria:

$D_{15\ (filter)}$>4 to 5 $D_{15\ (Base)}$

Gradation Control $D_{50(filter)}$<25 $D_{50\ (Base)}$

Sandy material in porous displacement pile performs as the filter. In-situ clayey silty soil which surrounds the compacted sandy material of the porous displacement pile, performs as the base in the above criteria. $D_{15}$ is the diameter for which 15% of the material by weight is finer and $D_{85}$ is the particle diameter for which 85% of the material by weight is finer. In geotechnical engineering, the focus of engineers is generally to make the best use of the available soils in the vicinity of the site. If for any reason, the sandy soils in the vicinity of the project site are slightly out of the requirements of the conservative Terzaghi's criteria, then laboratory tests could be performed such as described by Prakash and Gupta, 1972 or in publications of United States Bureau of Reclamation, to check whether on-site sandy soils meet the filtration characteristics of chimney filters.

During piezocone cone penetration sounding in highly stratified and heavily overconsolidated soft to stiff soil with cone penetration resistance ($q_c$) between 0.1 and 1 MPa, the penetration pore-water pressures ranging from 50 to 1.8 MPa (7.25 to 261 psi), values increasing with depth below ground surface were recorded from ground surface to depth of about 22-meter depth (Peuchen, 2010). During penetration of displacement piles in cohesive soils, penetration pore-water pressures of this magnitude shall be expected. Penetration pore-water pressures of 1.8 MPa equals 183.6 meter of water head from a 183 m (600 feet) high earth/concrete dam reservoir. Therefore, the compacted sandy soil of the porous displacement piles could experience such high pore-water pressures and therefore should meet the chimney filter criteria as used for earth and rockfill dams. In such cases, if about a 1" (25 mm) pipe with a porous disc at its bottom, is driven into porous a displacement pile, then one can see clear water flowing out from the top of the pipe.

The porous displacement piles comprising of the column of compacted sandy soil have been described above. There is another equally attractive method to install porous displacement piles to perform the same type of function, but it is more costly than the method already explained. Porous reinforced prestressed concrete piles (or even without prestress), or porous pipe section with the end plate, or pipe section with small holes and the end plate, filled by the compacted sandy material shall also be installed through inside the non-displacement piles and shall be used as the porous displacement piles, if (1) drivable by a pile driving hammer into the soil without exceeding allowable driving stresses, (2) allow free drainage and flow of water and prevent migration of fine soil particles of clays and silts or fine sand in to the porous displacement piles, (3) the holes in the tube or pipe section need to be quite small so as to retain sandy material during compaction in the pipe section. These porous displacement piles will not require pulling out of the pipe section out of the ground and the installation will also become easier and faster. In many cases where soil layers consist of very sticky clays or when batter piles are involved or when any more vibration or noise cannot be tolerated, pulling out a pipe section could be difficult or may not be allowed by authorities.

In many areas such as in earthquake zones, the local building code may not allow construction unless the relative density is above a certain value. Table 1 gives liquefaction-potential relationships between magnitude of earthquake and relative density for a water table 1.5 m below ground surface:

TABLE 1

Approximate relationship between earthquake magnitude, relative density ($D_r$) and liquefaction potential for water table 1.5 m below ground surface (From Seed and Idriss, 1971)

| Earthquake Acceleration | High Liquefaction Probability | Potential for liquefaction depends on soil type and earthquake acceleration | Low Liquefaction Probability |
|---|---|---|---|
| 0.10 g | $D_r$ < 33% | 33% < $D_r$ < 54% | $D_r$ > 54% |
| 0.15 g | $D_r$ < 48% | 48% < $D_r$ < 73% | $D_r$ > 73% |
| 0.20 g | $D_r$ < 60% | 60% < $D_r$ < 85% | $D_r$ > 85% |
| 0.25 g | $D_r$ < 70% | 70% < $D_r$ < 92% | $D_r$ > 92% |

In such cases, RCCM shall be used to densify subsurface soil layers as needed for the areas in 0.10 g zones to $D_r$ of more than 55%, then relative density of sandy soil in the pipe section may need to be compacted to a minimum of 55% or greater. In areas of 0.15 g zones, RCCM shall be used to densify subsurface soil layers to $D_r$ of more than 75%, then relative density of sandy soil in the pipe section may need to be compacted to a minimum of 75% or greater. In areas in the 0.20 g zones, RCCM shall be used to densify subsurface soil layers to $D_r$ of more than 85%, then relative density of sandy soil in the pipe section may need to be compacted to a minimum of 85% or greater in order to bring such areas in low liquefaction probability. In areas in the 0.20 g zones, RCCM shall be used to densify subsurface soil layers to $D_r$ of more than 85%, then relative density of sandy soil in the pipe section may need to be compacted to a minimum of 85% or greater in order to bring such areas in low liquefaction probability. In areas in the 0.25 g zones, RCCM shall be used to densify subsurface soil layers to $D_r$ of 95% or more than 95%, then relative density of sandy soil in the pipe section may need to be compacted to a minimum of 95% or greater in order to bring such areas in low liquefaction probability. The spacing and diameter of the porous displacement piles need to be designed in order to achieve displacement and void volume reduction of the in-situ soil to achieve required densification and density for the subsurface layers of the site. From the above discussions, it is stated that the requirement of compacting sandy soil in the pipe section (123) to the particular relative density and spacing and diameter of the porous displacement piles shall depend on the subsurface soil conditions at a site, and the requirements up to which the subsurface layers are to be densified at that site.

Typical Examples of Industrial Applications of the RCCM

Ground Improvement Under a Spread Footing

Figure 7A:
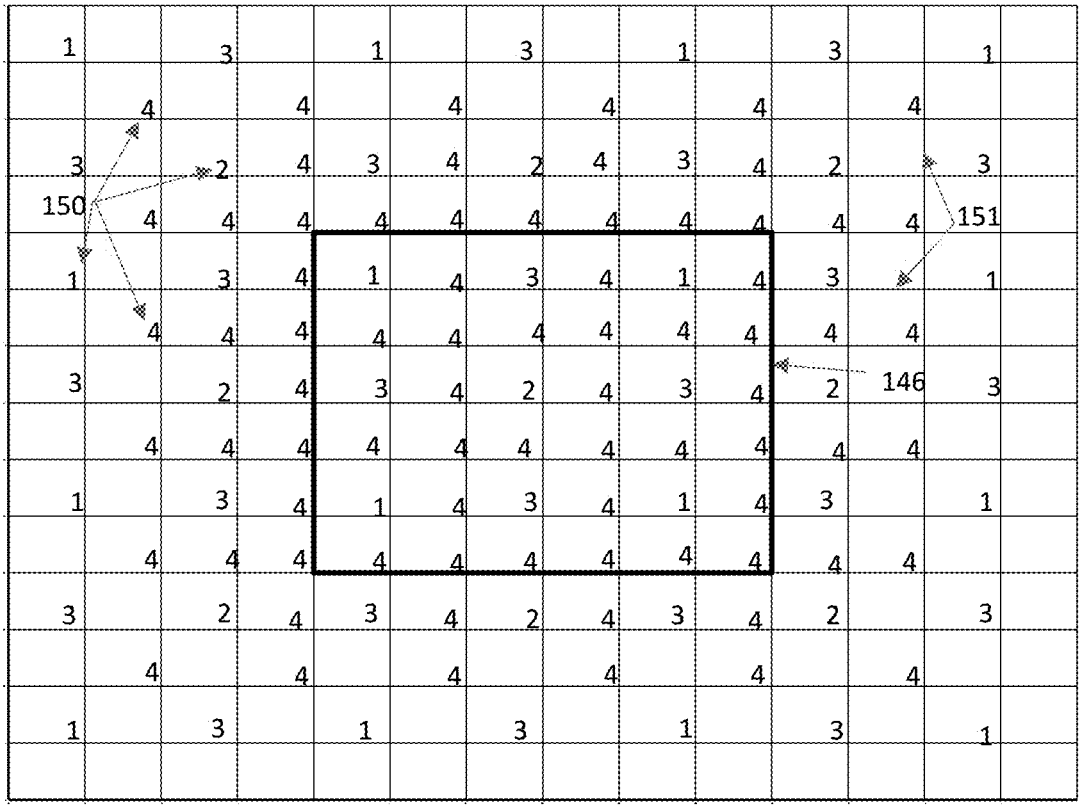
FIG. 7A: A typical plan showing the grid lines (151) and the locations (150) of porous displacement piles for soil improvement under a spread footing.

When a project requires ground improvement of the layer of soil, the RCCM can provide an economical and very useful solution. For example, a spread footing of a bridge foundation is to founded on soil which consists of a week layer of soil (140) and needs soil improvement in order to support the loads from the bridge superstructure. FIG. 7A shows a typical layout plan of the grid lines (151) and location of the center of porous displacement piles (150) consisting of the column of compacted sandy material (125) in a square or rectangular grid pattern. The locations marked by number "1" at the grid intersection (150) are the primary locations where the porous displacement piles shall be installed first, using the method described in the above paragraphs. The locations marked by number "2" at the grid intersection are the secondary locations where the porous displacement piles shall be installed after completing the installation at the primary locations. The secondary locations are usually selected at the center of grid of four primary locations. The locations marked by number "3" at the grid intersection are the tertiary locations where the porous displacement piles shall be installed after completing the installation at the secondary locations. The locations marked by number "4" at the grid intersection are the final and last locations where the porous displacement piles shall be installed after completing the installation at the tertiary locations. A similar arrangement for locations of the porous displacement piles can also be made in a triangular pattern or quadrilateral pattern as is done for vibro-replacement columns, or any other selected grid pattern selected for a particular configuration at a project site.

Figure 7B:
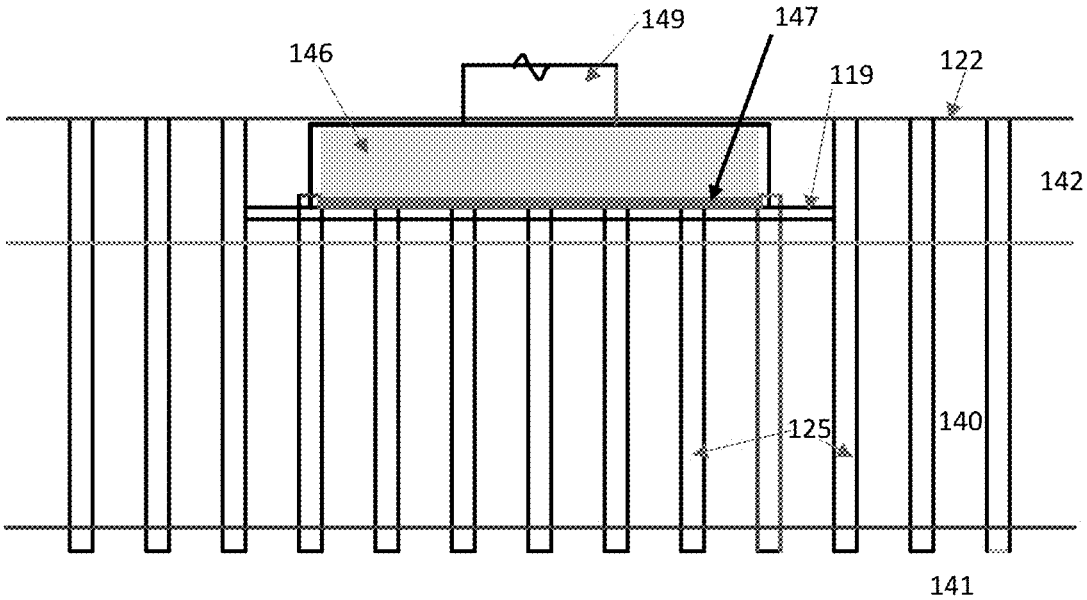
FIG. 7B: Sectional elevation showing the installed porous displacement piles (125) under the spread footing.

FIG. 7B shows a sectional elevation view of the grid pattern shown in FIG. 7A. In FIG. 7B, reinforced concrete foundation (146) has been laid over mud mat (147). The porous displacement piles consisting of compacted sandy materials are installed to the design depth in the layer, which in this case lies in the soil layer (141). CASE 1: Assume top Layer (142) and bottom layer (141) consists of sandy material and the sandwiched layer (140) consists soft clay. In this case the pipe section with detachable end plate can be driven from the ground surface without driving a non-displacement pile first, if the layer (142) is sufficiently thick to reasonably minimize the heave at the top of the weak layer (140), otherwise, it shall be advisable to drive non-displacement pile first and then drive the pipe section (123) with detachable end plate (124) through inside the non-displacement pile. CASE 2: Assume the top layer (142) consists of Clay and the sandwiched layer (140) consists of loose sand and requires densification. In this case, it is advisable to drive the non-displacement pile first to the bottom of the top layer (142) or to some small depth in loose sand layer (140). It shall be advisable to auger out the clayey soil from inside the non-displacement pile and the drive the pipe section (123) with detachable end plate (124) to the design depth. This shall avoid pushing the clayey soil into the loose sand layer, which can prevent instantaneous densification of the loose sand layer. Therefore, at each project, the subsurface soil profile shall be carefully examined and the installation method carefully designed. In some cases, the design may not require installation of porous displacement piles at tertiary (3) or final grid locations (4).

Ground Improvement Under Embankments

Figure 8A:
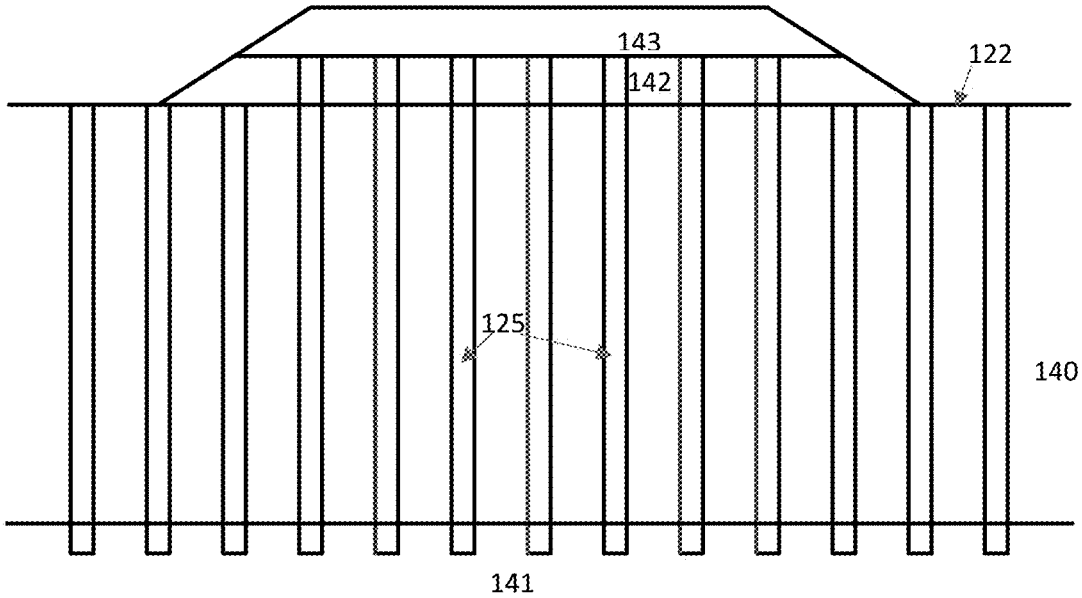
FIG. 8A: A typical detail of the installed porous displacement piles (125) under an embankment.
Figure 8B:
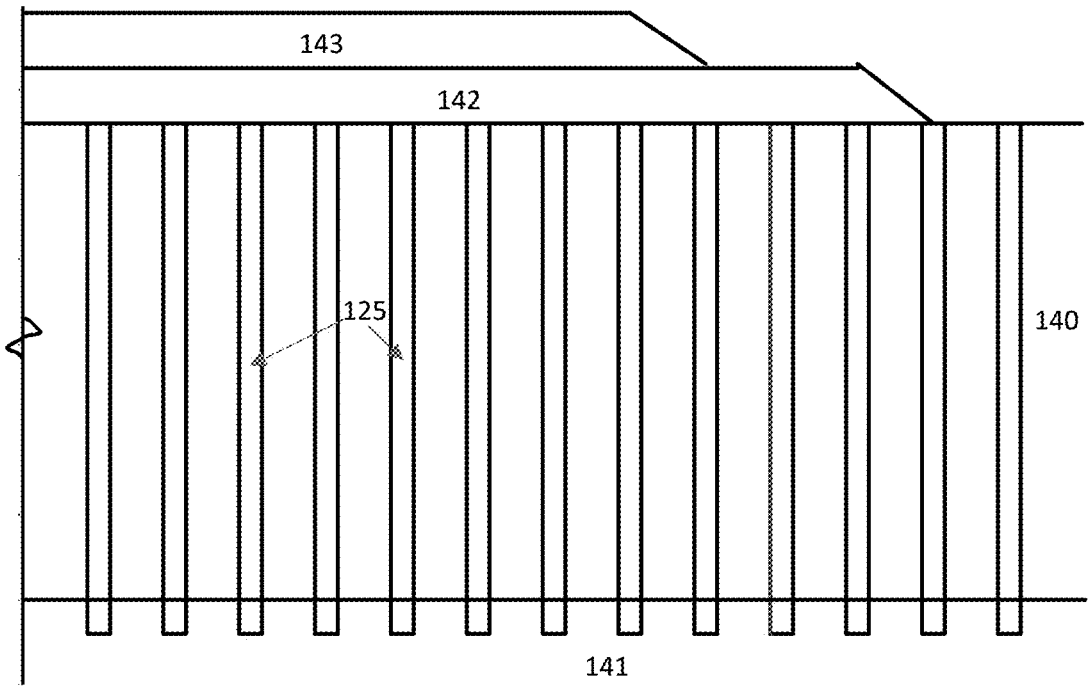
FIG. 8B: A typical detail of the installed porous displacement piles under an embankment with porous displacement piles at primary locations installed ahead of the embankment and the embankment extended on the installed porous displacement piles (125).

The RCCM can be used under mechanically stabilized walls (such as reinforcement earth wall) to reduce and limit their settlements and also to develop required stability. The slopes which are found not to have enough factor of safety based on slope stability analyses when densified by use of the RCCM, shall be able to develop required factor safety for slope failures. The road and highway embankments founded on very soft layers of soils sink and settle sometimes by several inches or feet or meters; and slopes of 2H:1V generally provided on opposite sides of the embankment are found to be unstable, therefore requiring very flat slopes. In such cases the RCCM shall densify the weak or soft soils under the embankments and reduce settlements to the reasonable limits and also improve the slope stability of the embankment slopes without requiring flatter slopes. One typical example is shown in FIG. 8A and FIG. 8B. As shown in FIG. 8A, a layer (142) of sandy material is first laid over very soft clayey soil to build an embankment of low height where the equipment can be brought to install the porous displacement piles consisting of the compacted sandy material. After the installation of the porous displacement piles, the embankment is further raised to full height by additional layers (143). As shown in FIG. 8B, the clayey soil is very weak and it cannot even support the embankment of low height to bring the equipment on it, then the porous displacement piles on primary locations (or even on secondary locations) can be installed ahead of the embankment of low height and then the embankment is extended further and then the porous displacement piles on secondary and tertiary locations can be installed.

The rapid consolidation and compaction method (RCCM) can also be used in coastal regions where embankment is to be further extended into the ocean to build new land for airports and housing projects etc., and where the subsurface soils consist of loose sands and soft to very soft clays. Similarly, new islands can be built even where subsurface soils consist of loose and soft and very soft soils underlies as these subsurface soils can be densified by the rapid consolidation and compaction method. To reduce down drag on the piles driven in clayey and silty soils, the sand drains or PVC (wick) drains are installed and an embankment is built over them to consolidate the clayey silty layer for certain time period for generally up to 90% consolidation and then sometimes the embankment is removed and the piles are driven. In place of sand drains or wick drains, the RCCM to install porous displacement piles can be used, which shall rapidly consolidate the layer without requiring to build an embankment and waiting for up to 90% consolidation. The RCCM can be used very economically for any layer of soils or intermediate geomaterial where soil improvement to densify it is required and also, where ever, presently existing methods such as jet grouted columns, columns of cement or lime mixed with clayey material or Geopiers or vibro-replacement or vibro-floatation using a Vibro-probe, stone-columns as bottom feed or top feed, etc., are being used.

Figure 9:
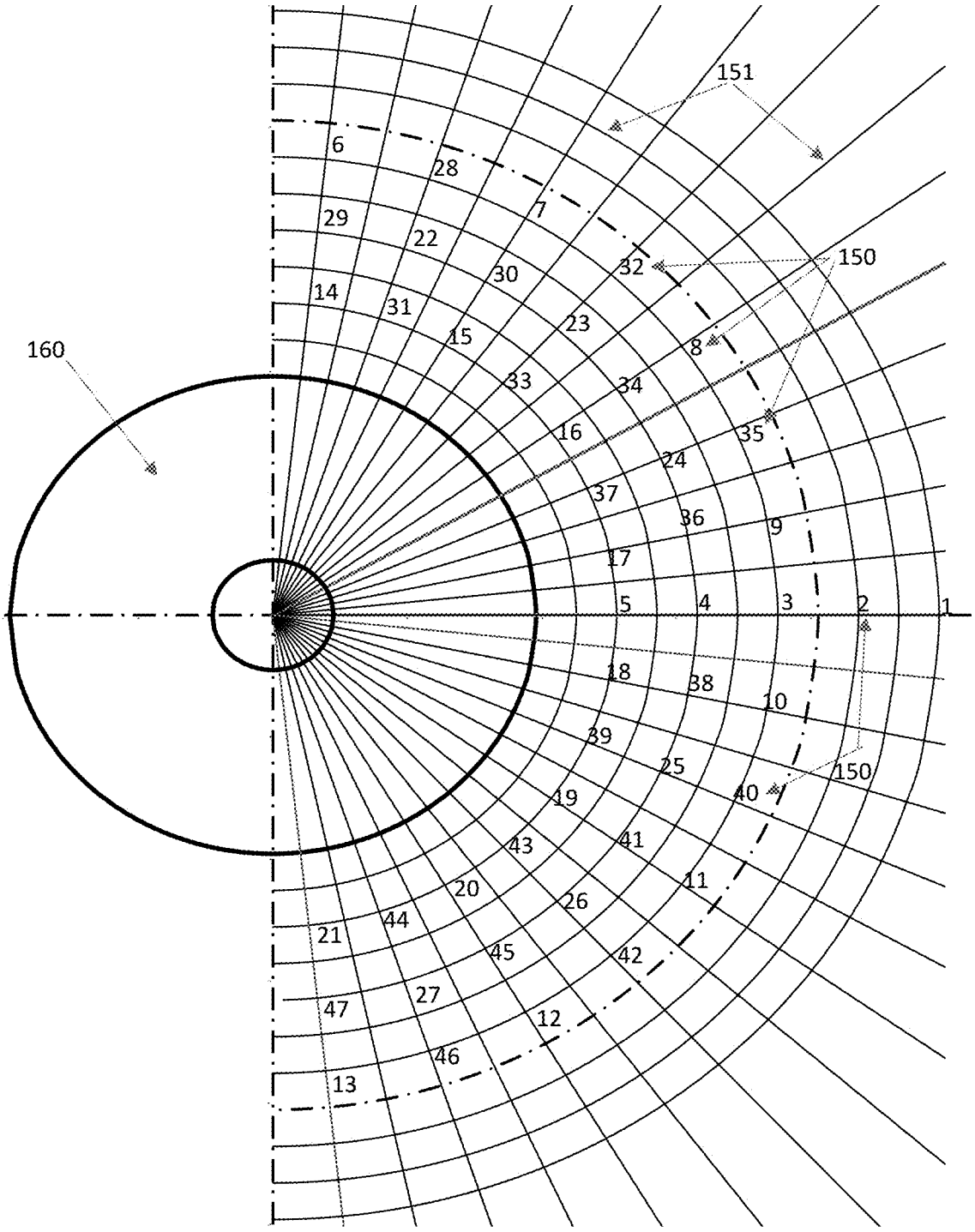
FIG. 9: A typical plan showing the grid lines (151) and the locations (150) of porous displacement piles for soil improvement under and by the side of foundation of the Leaning Tower of Pisa.
Figure 10:
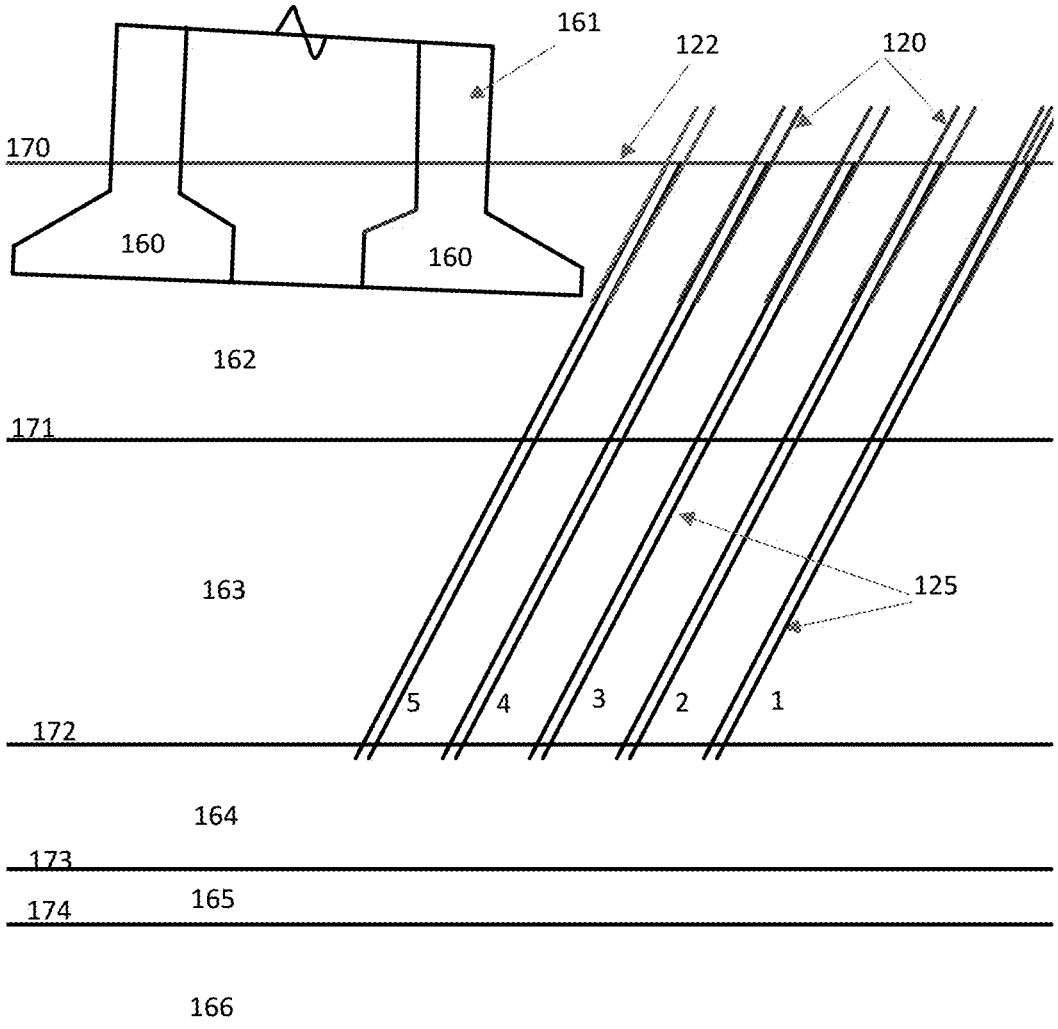
FIG. 10: A typical detail showing foundation of the Leaning Tower of Pisa and subsurface soil layers along with batter Porous Displacement Piles (125).

Ground Improvement Under Tilting or Leaning Structures Such as the Leaning Tower of Pisa There are many structures throughout the world which have tilted either during construction or after completion of the construction. The ground improvement using the rapid consolidation and compaction method for installation of porous displacement piles can improve the foundation soils which will also result in reducing the angle of tilt significantly and bring the leaning structure close to about vertical. There are many other structures in the Town of Pisa, Italy, which are tilting like Leaning Tower of Pisa, but not to this extent. First the porous displacement piles should be installed at other tilting structures of Town of Pisa to demonstrate the effectiveness of soil improvement in succeeding to reduce the tilt with underlying subsurface conditions, before considering to install porous displacement piles at the Leaning Tower of Pisa to reduce the tilt. To reduce the angle of tilt of the Leaning Tower of Pisa, (i) the lead weights have been placed on the north side on prestressed concrete ring around the foundation of the leaning tower of Pisa, (ii) steel cables to anchor the tower on north side to limit movement towards south, (iii) Drill holes installed to remove soil from the drilled holes on the north side, and (iv) some excavation in east-west direction (Jamiolkowsky, et al., 1993). However, no construction on the southside has been permitted and even subsurface exploration consisting cone penetration soundings has been permitted 10 to 20 meters from the south edge of the tower in order not to disturb the tower, although construction as stated above has been permitted on the north side. Prior to installation of porous displacement piles, the additional steel cables to anchor the tower could be considered to further anchor the tower by steel cables in north-east and north-west directions. If permission is granted by the concerned authorities, the scheme of installation of porous displacement piles as shown in FIG. 9 and FIG. 10 could be worth consideration to consolidate and densify the upper clay (named locally as Pancone Clay) between El. −7 m and −18 m, which has cone penetration resistance, $q_c$, only between 1 to 1.5 MPa (Jamiolkowsky, et al., 1993). The porous displacement piles are proposed to be installed at a batter of about 1V:2H (or even between 1V:3H and 1V:1H as considered necessary), in order to achieve densification of the upper clay (163) and to possibly lift the foundation of the south side of the Leaning Tower of Pisa. When Upper Clay (160) is densified, its bearing capacity shall increase resulting in less settlement on the south side. When the angle of tilt is reduced, the bearing pressure on the south side will reduce and the bearing pressure on the north side will increase, causing more settlement on north side and reducing settlement on the south side of the tower foundation. Also, after stabilizing and densifying the Upper Clay (163), the tendency to further tilt on the south side of the tower foundation in future will be prevented. The following description is to demonstrate the industrial application of the ground improvement under a leaning structure to reduce its tilt. For that purpose, the Leaning Tower of Pisa has been selected. Following steps are advisable to implement the scheme:

1. Perform subsurface investigation near the south side of the tower.
2. Install instruments to monitor vibrations and settlements both on ground surface and in selected depths below the ground surface and around the tower above the ground level.
3. Perform radar survey at designated points around the tower above ground level, before and during implementation of the scheme.
4. FIG. 9 shows the grid lines (151) and the locations (150) at grid line intersections, where the porous displacement piles could be installed.
5. FIG. 10 shows: (a) Ground surface elevation as El. 3.0 m (170), (b) elevation of the bottom of Clayey and Sandy yellow silt (162) as El. −7 m (171), (c) the elevation of the bottom of Upper Clay (163) as El. −18 m (172), (d) the elevation of bottom of the Intermediate Clay (164) as El. −22.5 m (173), (e) the elevation of the bottom of the Intermediate Sand (164) as El. −24.5 (173), and (f) Lower Clay (166) underlies the intermediate sand (165).
6. The outside diameter of tower foundation (162) is 19.58 m with 4.5 m diameter circular space in the center. Lower portion of tower is designated as reference number 161 in FIG. 10. Non displacement piles (120) at a batter of 1H:2V are proposed to be driven first up to the bottom level of the foundation of tower. Pile Section (123) with detachable end plate (124) and filled with compacted sandy material shall then be driven through the non-displacement pile (120) to penetrate some small distance in the Intermediate Clay (164). After which the pipe section will be pulled out of the ground followed by withdrawal of non-displacement pile. The porous displacement pile (125) numbering from 1 through 5 shall be driven first as shown in this Figure. Pipe section (123) and detachable end plate (124) has not been shown in this Figure.
7. The porous displacement piles at Grid Intersection Location No. 1, which is 15 meters from the south edge of the Leaning Tower, and then at Location No. 2 about 12 meters from the south edge, followed by at Location No. 3 at 9 meters from the south edge, at Grid location 4 at 6 meters from south edge and Grid intersection location no. 5 at 3 meters from the south edge could be installed successively, to monitor and observe the settlement, vibrations and movements etc., continuously and to analyze the effects of installing the porous displacement piles around the tower when their locations get closer to the tower foundations.
8. When recorded data has been analyzed to determine the safety of the tower and when found satisfactory after installation of each porous displacement pile, then only the installation of the remaining porous displacement piles could be considered.
9. If permitted by the authorities, the installation at primary location in the following order could be considered: primary locations 6 through 13, then 14 through 21.
10. After analyzing the data and considered satisfactory to move ahead, then installation at tertiary location in the following order could be considered: Locations 22 through 27, then 28 through 47 could be considered. Tertiary locations could be considered after evaluating the reduction in tilt of the leaning tower.
11. Subsurface exploration to be done to evaluate the improvement of properties of Upper Clay after completion of the construction of porous displacement piles.
12. Although only installing the batter porous displacement piles has been shown in FIG. 10, the vertical porous displacement outside the tower foundation in addition to those shown in FIG. 9 and FIG. 10 could also be installed to improve the density of upper clay outside of the tower foundation. The dispersion of the load of tower or any foundation is considered to occur at a slope of about 60 degrees.
13. In place of the installation of porous displacement piles consisting of the column of compacted sandy soil, the porous displacement pile consisting of porous pipe section with attached end plate or pipe sections with holes and containing compacted sandy material and end plate can be considered, as these sections will not need to be pulled out of the ground, and will not involve the disturbance and noise which will be associated with pulling the pipe section out of the ground. These porous displacement piles shall also be driven through inside the non-displacement piles.

Densification Under a Structure Undergoing Settlement

When a structure such as a building or an oil or water tank is continuously undergoing settlement on all of its sides, then batter porous displacement piles on all sides penetrating under the structure could be installed to prevent or reduce further settlements significantly. The batter displacement piles shall be required to be installed in particular sequence, so that any instant, these are evenly located symmetrically around a structure. Porous displacement piles might consist of the column of compacted sandy soil and installed as described above. To reduce vibrations, noise and disturbance, the porous displacement piles comprising porous pipe section or pipe section with small holes and with end plate and filled with compacted sandy soil could also be considered to be installed. All displacement piles shall be driven through inside the non-displacement piles. The selection shall be made for a particular site based on soil conditions and environment around the structure.

TEACHINGS OF THIS APPLICATION

The various aspects of what is described in the above sections, can be used alone or in other combinations for other type of applications. The teaching of this application is not limited to the industrial applications described here-inbefore, but it may have other applications. Therefore, teaching of the present application has numerous advantages and uses. It should therefore be noted that this is not an exhaustive list and there may have other advantages and uses which are not described herein. Although the teaching of the present application has been described in detail for purpose of illustration, it is understood that such detail is solely for that purpose, and variations can be made therein by those skilled in the art without departing from the scope of the teaching of this application. Features described in the preceding description/specification may be used in combination, other than the combinations explicitly described. Whilst endeavoring in the forgoing specification/description to draw attention to those features of the invention believed to be of particular importance, it should be understood that Applicant and Inventor claims protection in respect of any patentable feature or combinations of features hereinbefore referred to and/or shown in the drawings/Figures whether or not particular emphasis has been placed thereon. The term "comprising" as used in the claims does not exclude other elements or steps. The term "a" or "an" as used in the claims does not exclude plurality. A unit or other means may fulfill the functions of several units or means recited in the claims. As various possible embodiments might be made of the above invention, and as various changes might be made in the embodiments above set forth, it is to be understood that all matter herein described or shown in the accompanying drawings is to be interpreted as illustrative and not in a limiting sense.

REFERENCES

Bowles, E. B. Foundation Analysis and Design, Fourth Edition, 1981, McGraw-Hill Book Company, New York, N.Y., USA.

Jamiolkowski, M., Lancellotta, R., and Pepe, C. (1993) "Leaning Tower of Pisa-Updated Information", Proceedings, Third International Conference on Case Histories in Geotechnical Engineering, Jun. 1-4, 1993, SOA, St. Louis, Mo., USA.

Kennedy, G. D., and Woods, K. B. (1954). "Vertical Sand Drains," Highway Research Board, Bulletin 90, Washington, D.C., USA.

Mars, B. N., "Compaction of Soil," U.S. Pat. No. 4,126,007, issued on Nov. 21, 1978, United States Patent and Trade Mark Office, Alexandria, Va., USA.

Peuchen, J., Berghes, J. F. V., and Coulais, C. (2010), "Estimation of $u_1/u_2$ conversion factor for piezocone," Second International Symposium on Cone Penetration Testing, California, USA.

Pile Dynamics, Inc. (2005) "GRLWEAP, Wave Equation Analysis of Pile Driving", Cleveland, Ohio, USA.

Prakash, D. and Gupta, R. C. (1972), "Laboratory Studies on Filter Materials Placed at Ramganga Main Dam," Indian Geotechnical Journal, Vol. 2, No. 3, July 1972, pp. 203-219, New Delhi, India.

Schaefer, V. R., Berg, R. R., Collin, J. G., Christofer, B. R., DiMaggio. J. A., J, A, Filz, G. M., Bruce, D. A., and Ayala, D. (2016). "Ground Modification Methods-Reference Manual", Volume 1, Geotechnical Engineering Circular No. 13, FHWA-NHI-16-027, US Department of Transportation, Washington, D.C. USA.

Seed, H. B., and Idriss, I. M. (1971) "Simplified Procedure for Evaluating Soil Liquefaction Potential", JSMFD, ASCE, Vol. 97, SM 9, September, pp. 1249-1273.

The invention claimed is:

1. A rapid consolidation and compaction method for densifying various layers of soils and intermediate geomaterials in a soil deposit, the rapid consolidation and compaction method comprising: (i) installing porous displacement piles comprising a pipe section with a removable end plate and filled with compacted sandy soils, in at least one layer of very soft, soft, medium stiff, stiff, very stiff clayey and silty soil for the rapid consolidation and densification of the clayey and silty soil and/or of very loose, loose, medium dense, dense sandy soil for instantaneous densification of the sandy soil; (ii) first driving a non-displacement pile comprising of a pipe section into ground; (iii) filling and compacting each and every layer of the sandy soil to a specified relative density in the pipe section attached with the removable end plate when the said pipe section is held laterally in vertical position above a ground surface, either at the same location where the said pipe section filled with compacted sandy soil and with the removable end plate to be driven into the ground or at a distant location other than where the said pipe section filled with the compacted sandy soil and with the removable end plate to be driven into the ground; (iv) the compacted sandy soil to be in compliance of a filter design criterion, gradation, that is particle size distribution of the compacted sandy material shall be designed to allow free flow of the excess water for dissipating the excess pore-water pressures or the excess pore-air pressures and also to prevent migration of fine particles of in-situ soil; (v) driving the displacement pile comprising the said pipe section filled with compacted soil and with the removable end plate into the ground through inside the non-displacement pile; (vi) after driving the displacement pile, placing a weight or a hammer on top of the compacted sandy soil in the pipe section before pulling the pipe section out of the ground; (vii) during pulling the pipe section of the displacement pile out of the ground, the removable end plate opens 100 percent of inside area of the pipe section; (viii) during pulling the pipe section of the displacement pile, placing the weight or the hammer on top of the compacted sandy soil in the pipe section in order to continue to push the compacted sandy soil vertically downwards to fill the compacted sandy soil in the space previously occupied by the pipe section to form a column of compacted sandy soil; (ix) leaving the column of the compacted sandy soil in the ground, after pulling out of the pipe section of the displacement pile out of the ground; (x) therefore, an area of cross-section of the column of the compacted soil is at least equal or more than the inside area of the pipe section; (xi) the column of the compacted sandy soil left in the ground after pulling out of the pipe section, behaves as a porous displacement pile up to a depth up to which the pipe section of the displacement pile was driven; (xii) the porous displacement pile occupies space previously occupied by the clayey and silty soil and develops excess pore-water pressures in saturated clayey and silty soil and the excess pore-water pressures and the excess pore-water pressures in partially saturated clayey and silty soil, by pressurizing the pore-water and pore-air present in the pores of the saturated clayey and silty soil; (xiii) the excess pore-water pressures and pore-air pressures developed in the clayey and silty soil are rapidly dissipated by flow of the pressurized pore-water and pore-air through the porous displacement pile to the ground surface or to the sandy layer located within the ground, thereby densifying the clayey and silty soils; (xiv) the displacement pile displaces the at least one layer of sandy soil below the non-displacement pile; (xv) the porous displacement pile occupies the space previously occupied by the sandy soil reducing volume of voids of the soil matrix and densifying the sandy soil instantaneously; (xvi) in the sandy soil, the excess pore-water pressures do not develop and if develop, dissipate immediately; (xvii) installing a plurality of the porous displacement piles spaced apart in a grid pattern in the entire area requiring densification; (xviii) installing the porous displacement piles either vertically or at a batter; (xix) wherein using one of following three methods for compacting sandy soil in the pipe section above the ground; (xx) in first method, filling the sandy soil in the layers in the pipe section and compacting and densifying each layer by drops of the hammer or the weight; the sandy soil is filled in the layers in the pipe section and each layer compacted and densified by drops of the hammer or the weight; (xxi) wherein a connecting rod connects the weight or the hammer to a boom of crane or to a pile driving hammer; (xxii) in second method, filling each layer of the sandy soil in the pipe section and placing hammer or weight on the top of the sandy soil in the pipe section; (xxiii) wherein then a surface vibrator is attached on side of the pipe section and the pipe section is vibrated to compact and densify each layer of the sandy soil inside the pipe section; (xxiv) in third method, filling each layer of the sandy soil in the pipe section and placing the hammer or the weight on the top of the sandy soil in the pipe section and vibrating the hammer or the weight for densifying the sandy soil inside the pipe section; (xxv) the pipe section during compaction of the sandy soil is laterally supported to maintain the pipe section in vertical position; (xxvi) wherein depending on subsurface soil conditions at a site, and specifications up to which subsurface soil layers to be densified at that site (a) compacting the sandy soil in the pipe section to a particular relative density to either medium dense or dense or very dense sand condition and (b) using appropriate spacing and diameter of the porous displacement piles in the grid pattern.

2. The rapid consolidation and compaction method for densifying the various layers of the soils and the intermediate geomaterials in the soil deposit in accordance with claim 1, for attaching the removable end plate to the pipe section, the rapid consolidation and compaction method further comprising:

(i) wherein using one of the following three different methods to attach the removable end plate at end of the pipe section;

(ii) wherein in the first method, attaching the removable end to the pipe section by a hinged connection;

(iii) wherein during withdrawal of the pipe section out of the ground, bottom of the pipe section opens fully, because the removable end plate becomes vertical at the side of the hinged connection opening the bottom of the pipe section in vertical piles;

(iv) wherein for batter porous displacement piles, the removable end plate with the hinged connection aligns in longitudinal direction of the batter of the displacement pile, opening the bottom of the pipe section;

(v) in the second method, connecting a removable short pipe section to the removable end plate and then inserting both together at the end of the pipe section;

(vi) wherein, the short pipe section is snug to the inside of the pipe section or the short pipe is attached to the pipe section by thin aluminum rivets which break when the pipe section is being pulled out;

(vii) wherein during the withdrawal of the pipe section out of the ground, the pipe section opens fully and the short pipe section attached to the removable end plate is left behind at the bottom of the column of the compacted soil;

(viii) in the third method, connecting a plurality of connecting rods by bolts to the removable end plate located at the bottom of the pipe section and thereafter, connecting and fastening the connecting rods at the top of the pipe section;

(ix) wherein when the pipe section filled with the compacted sandy soil has been driven in the ground, unfastening the bolts at the top of the pipe section to allow the connecting rods and the attached removable end plate to disengage with the pipe section during the withdrawal of the pipe section;

(x) wherein therefore, when the pipe section is being pulled out of the ground, the connecting rods and the removable end plate are left in the ground.

3. The rapid consolidation and compaction method for densifying the various layers of the soils and the intermediate geomaterials in the soil deposit in accordance to claim 2, for transporting the pipe section filled by the compacted soil to another location, the rapid consolidation and compaction method further comprising:

(i) when the pipe section has been filled and compacted at the location other than that where it is to be driven, then for the first method, in addition of the hinged connection on one side, an angle bolted to the removable end plate and the pipe section at diametrically opposite side of the hinged connection, or at equal spaced points if more than one angle bolted to the pipe section and the removable end plate;

(ii) wherein after attaching the at least one angle to the pipe section and the removable end plate, mobilizing the pipe section filled with the compacted sandy soil to the location where it is to be driven;

(iii) wherein removing the angle section or the angle sections when the pipe section transported to the location where the pipe section to be driven and when the removable end plate in contact to the ground, but not resting on it to easily pull out the angle or angles;

(iv) when the pipe section has been filled and compacted at the location other than where it is to be driven, then for the second method, attaching the short pipe section to the removable end plate, and connecting to the pipe section by a plurality of bolts to hold the compacted sandy material in the pipe section in place;

(v) wherein removing the bolts after the pipe section has been transported to the location where the pipe section to be driven and when the removable end plate in contact with the ground.

* * * * *